US007134636B2

(12) United States Patent
Callies

(10) Patent No.: US 7,134,636 B2
(45) Date of Patent: Nov. 14, 2006

(54) POST SUPPORT

(75) Inventor: Gerald E. Callies, New Prague, MN (US)

(73) Assignee: United Steel Products Company, Montgomery, MN (US)

( * ) Notice: Subject to any disclaimer, the term of this patent is extended or adjusted under 35 U.S.C. 154(b) by 0 days.

(21) Appl. No.: 11/175,542

(22) Filed: Jul. 6, 2005

(65) Prior Publication Data

US 2005/0279897 A1 Dec. 22, 2005

Related U.S. Application Data

(63) Continuation-in-part of application No. 10/874,147, filed on Jun. 22, 2004.

(51) Int. Cl.
*F16M 13/00* (2006.01)

(52) U.S. Cl. ..... 248/530; 248/156; 248/218.4; 248/300; 256/DIG. 5

(58) Field of Classification Search ..... 248/530, 248/156, 545, 218.4, 300; 256/DIG. 5, 65.14; 52/153, 165, 298, 297 X, 296, 736.3, 737.4, 52/737.5; 403/361
See application file for complete search history.

(56) References Cited

U.S. PATENT DOCUMENTS

| | | | | | |
|---|---|---|---|---|---|
| 891,448 | A * | 6/1908 | Snider | 52/157 |
| 4,269,010 | A * | 5/1981 | Glass | 52/154 |
| 4,469,302 | A * | 9/1984 | Stoudt | 248/512 |
| 4,588,157 | A | 5/1986 | Mills | |
| 4,644,713 | A * | 2/1987 | Lehman | 52/165 |
| 4,754,712 | A * | 7/1988 | Olson et al. | 108/107 |
| 4,860,940 | A | 8/1989 | Mills | |
| 5,695,166 | A | 12/1997 | Watts | |
| 5,927,677 | A * | 7/1999 | Speece et al. | 248/516 |
| 6,308,926 | B1 * | 10/2001 | Meyer | 248/530 |
| 6,402,115 | B1 * | 6/2002 | Groff et al. | 248/508 |
| 6,461,084 | B1 * | 10/2002 | Stuart | 405/244 |
| 6,575,417 | B1 * | 6/2003 | Krommenakker | 248/311.2 |

* cited by examiner

*Primary Examiner*—Korie Chan
(74) *Attorney, Agent, or Firm*—Dorsey & Whitney LLP

(57) ABSTRACT

A post support having a post receiving box. The box includes a pair of adjacent sides having internally raised portions and a pair of opposite sides being free of such raised portions and being substantially open along one edge.

2 Claims, 3 Drawing Sheets

POST SUPPORT

RELATED APPLICATION

This is a continuation-in-part of U.S. patent application Ser. No. 10/874,147 filed Jun. 22, 2004.

BACKGROUND OF THE INVENTION

1. Field of the Invention

The present invention relates generally to a post support and more specifically to a post support having a ground engaging or other supporting portion and a post receiving portion or box.

2. Description of the Prior Art

A variety of post supports currently exist in the prior art. Examples are shown in U.S. Pat. Nos. 4,588,157; 4,860,940 and 5,695,166. Some of these prior post supports address the issue of accommodating oversized or undersized posts. For example, U.S. Pat. No. 4,588,157 discloses means for enabling an under-sized post to be rigidly supported in the box section and/or for removing excess post material from an oversized post. U.S. Pat. No. 5,695,166 discloses means in the form of a pair of flanges and a bolt passing through holes in such flanges to securely hold an undersized post.

While some of the prior art post supports are acceptable in some respects, there is a continuing need for a post support to accommodate a post which does not run true to its nominal dimension, i.e., an undersized or oversized post.

SUMMARY OF THE INVENTION

The present invention is directed to a post support having a ground engaging or other supporting member and a post receiving box or upper section. The post receiving box or upper section includes a partially closed bottom, a plurality of side walls, an open top and means on at least one of the side walls for accommodating an undersized or an oversized post.

In the preferred embodiment, the plurality of sides form a box-like post receiving structure in which one of the corners is slit or unconnected along a substantial portion of its length, with the three other corners being joined with an adjacent side along substantially their entire length. Further, in the preferred embodiment, the two sides opposite the open corner are provided with a plurality of inwardly raised portions, with the sides adjacent to the open corner being free of any such raised portions. Still further, the post support of the preferred embodiment includes openings in each of the sides adjacent to the open corner to receive a bolt or other threaded bolt or other threaded member for the purpose of securing the post within the box.

Accordingly, an object of the present invention is to provide a post support for accommodating an under-sized or an oversized post.

This and other objects of the present invention will become apparent with reference to the drawings, the description of the preferred embodiment and the appended claims.

DESCRIPTION OF THE PREFERRED EMBODIMENT

Figure 1:
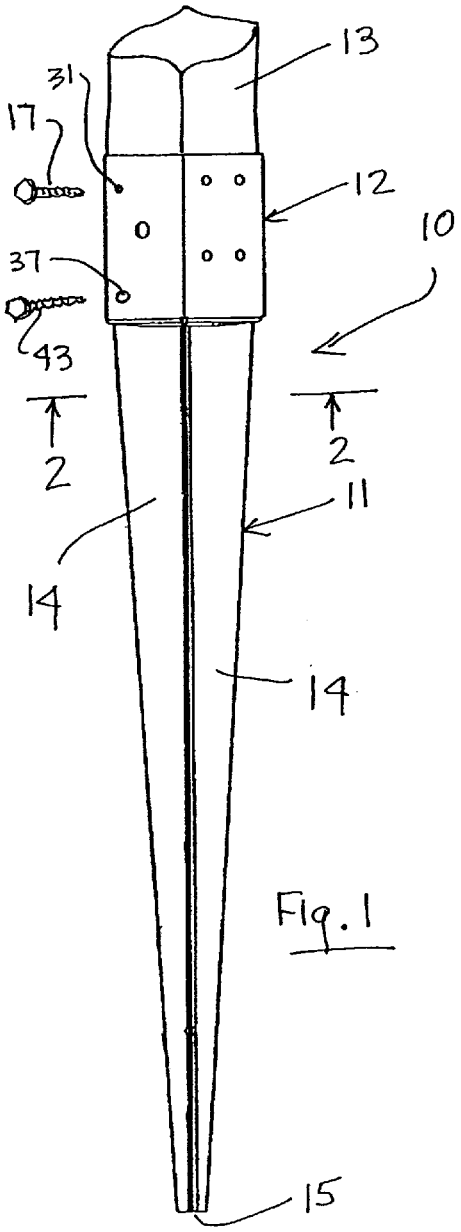
FIG. 1 is a front view of the post support of the present invention.
Figure 2:
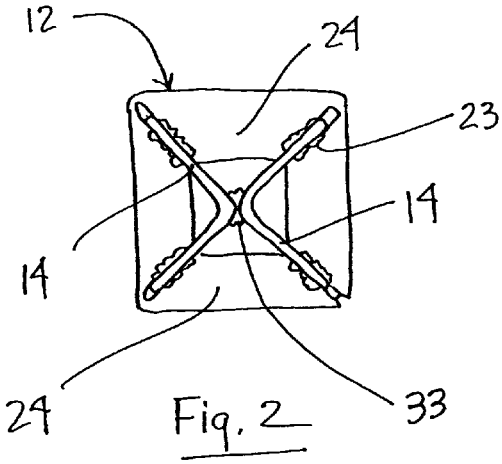
FIG. 2 is a view, partially in section, of the post support of FIG. 1 as viewed along the section line 2—2 of FIG. 1.

With initial reference to FIGS. 1 and 2, the present invention is directed to a post support 10 having a substrate engaging member in the form of the ground engaging portion 11 and a post receiving portion or box 12. The ground engaging portion 11 is an elongated structure having four leg portions 14 and a generally cruciform cross-section as shown best in FIG. 2. Each of the elongated legs 14 is connected at its top end to the post receiving portion box 12 by welding 23 or the like and each of the legs 14 converges or narrows in width as it extends from its top end to the bottom end 15 of the portion 11. When in use, the portion 11 is designed to be driven into the ground to support the box 12 and thus a connected post 13 above the ground in an upright position.

Figure 12:
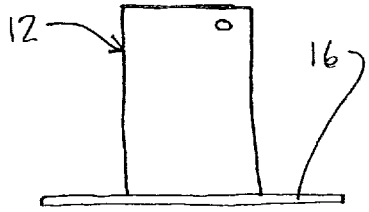
FIG. 12 is a side elevational view showing a post support with an alternate substrate engaging portion.

The structure of the ground engaging portion 11 can take a variety of forms and can include any number of legs 14 or other supporting elements or may have no legs at all. For example, as shown in the embodiment of FIG. 12, the bottom of the post receiving portion 12 can be connected with, or formed into, a mounting plate 16 or the like. With this structure, the plate 16 may be provided with a plurality of holes for connection via bolts or other threaded members to a deck or other substrate. In the preferred embodiment of FIG. 1, the ground engaging structure 11 is comprised of two angle members, each having a pair of legs 14 extending at right angles to one another and which are joined together via welding 33 or the like along their respective corners.

Reference is next made to FIGS. 3, 4, 5 and 6 showing various views of the post receiving portion or box 12. The post receiving box is a generally rectangular structure having an open top, a partially open bottom and a plurality of sides 18, 19, 20 and 21. Each of the sides 18, 19, 20 and 21 includes a bottom edge which is integrally joined with a generally trapezoidal shaped tab 24 at the corner 22. The tab 24 extends inwardly toward the center of the box 12 as shown best in FIGS. 4, 5 and 6. The side edges of each of the tabs 24 are slightly spaced from the side edge of an adjacent tab 24 to facilitate welding of the top ends of the legs 14 to the bottom of the post receiving box 12. Specifically, the upper ends of the legs 14 are positioned in the gaps between the tabs 24. While the preferred embodiment contemplates the top ends of the legs 14 being connected by welding to the gaps or joints between the tabs 24, the legs can be connected in a variety of other ways to the box 12.

Figure 4:
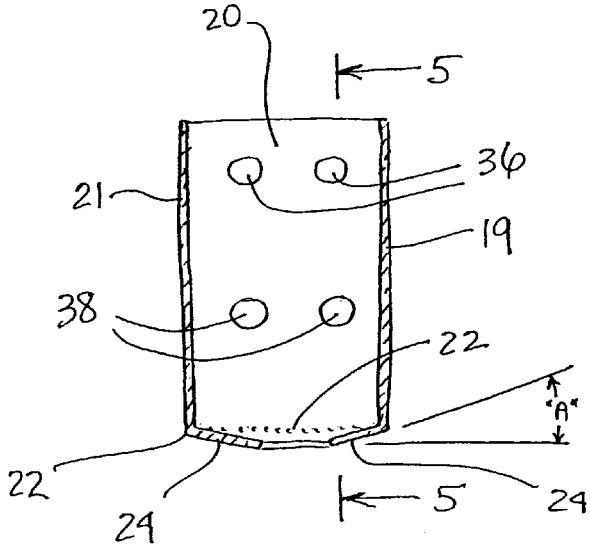
FIG. 4 is a view, partially in section, as viewed along the section line 4—4 of FIG. 3.

As shown best in FIG. 4, the tabs 24 extend inwardly from the corners 22 at an angle "A". Thus, the tabs 24 slope downwardly as they extend inwardly toward the center of the post receiving box 12. This enables water or other moisture to drain from the box 12 in order to keep the bottom of the post 13 dry, thereby minimizing rot or other deterioration. Preferably, this angle "A" is greater than 0° and more preferably between about 5° and 10°.

Figure 3:
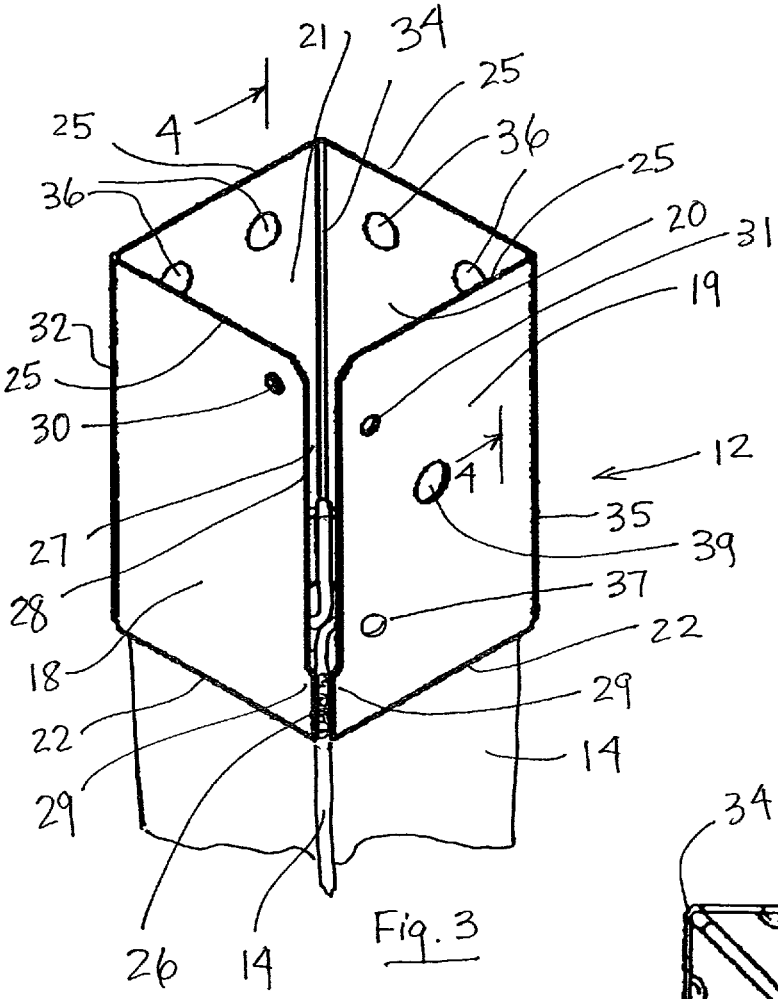
FIG. 3 is an isometric view of the top post receiving box and a portion of the ground engaging means of the post support in accordance with the present invention.
Figure 5:
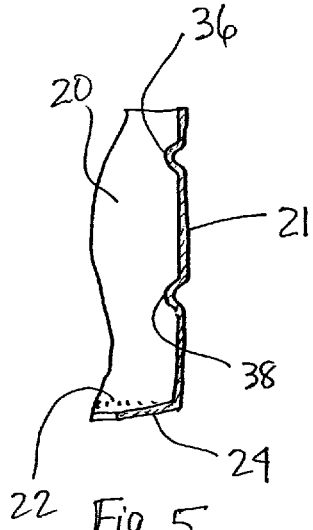
FIG. 5 is a view, partially in section, as viewed along the section line 5—5 of FIG. 4.

With continuing reference to FIG. 3, each of the box sides 18, 19, 20 and 21 further includes a top edge 25 which defines the open top of the post receiving box 12 and a pair of side edges which are either fully or partially connected to an adjacent side at the corners 28, 32, 34 and 35. Specifically, as shown, adjacent side edges of the sides 18 and 19 are partially connected with one another at the corner 28 near their lower ends by the welding 26. The upper portion of the adjacent side edges of the sides 18 and 19 remain unconnected and form a gap 27. In the preferred embodiment, this gap 27 may vary from one-eighth of an inch or less to one-quarter of an inch or more. To facilitate formation of the gap 28, the lower portion of the adjacent side edges of the sides 18 and 19, in the area of the weld 26, are provided with a short outwardly extending tab 29. In the preferred embodiment, the adjacent side edges of the sides 18 and 19 are connected via welding only near their lower portions. In the preferred embodiment, the connection or welded portion 26 extends upwardly from the bottom edge about 5% to 30% of the length of the side edges and more preferably, about 10 to 20% of such length. Thus, the adjacent side edges of the sides 18 and 19 are unconnected for about 70% to 95% of their length and more preferably about 80% to 90% of their length.

Each of the sides 18 and 19 includes an opening 30 and 31, respectively, to receive a lag bolt 17 (FIG. 1) or other connecting member. The lag bolt 17 secures the post 13 within the box 12 when in use. If desired, at least one of the sides 18 and 19 which includes the opening 30 and 31 can include a further opening 37 for receiving a further lag bolt 43. Preferably, the two holes 30 and 31 are positioned above the center of their respective sides 18 and 19 and the opening 37 is below the center of its respective side 19. If all three holes, 30, 31 and 37 are utilized with corresponding lag bolts 17 and 43, the corner between the sides 18 and 19 can be connected and the raised portions 36,36 and 38,38 (hereinafter described) can be eliminated.

Figure 6:
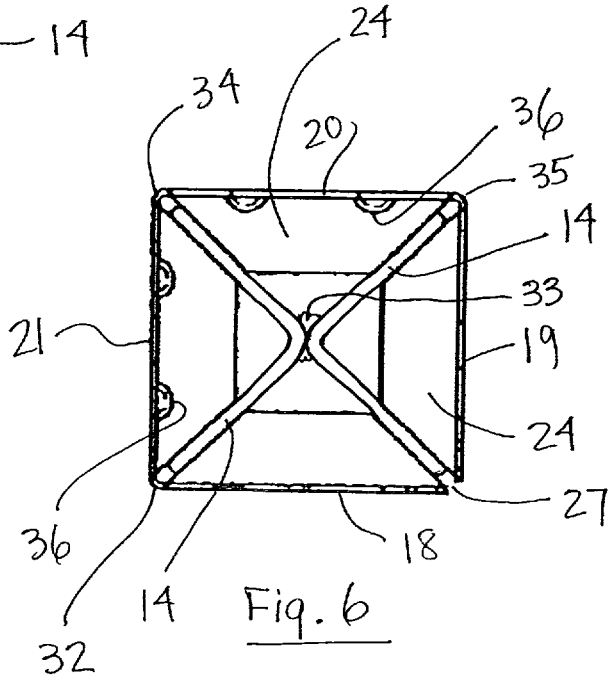
FIG. 6 is an elevational top view of the post receiving box of the post support in accordance with the present invention.

With continuing reference to FIGS. 3 and 6, the opposite side edge of the side 18 is connected with an adjacent side edge of the side 21 at the corner 32, the opposite side edge of the side 19 is connected to the side 20 at the corner 35 and the adjacent side edges of the sides 20 and 21 are connected with one another at the corner 34. Each of these connections, defined by the corners 32, 34 and 35, extend along the entire length of the side edges and are integral connections. In other words, the sides 19, 20, 21 and 18 are integrally connected with one another along the corners 35, 34 and 32, without welds or other connecting means.

Each of the sides 20 and 21 which are opposite to the unconnected or open corner 28 is provided with a plurality of raised portions on its inner surface. These raised portions comprise a pair of upper raised portions 36,36 and a pair of lower raised portions 38,38. As shown best in FIG. 5, these inwardly extending raised portions 36 and 38 form inwardly extending dimples which may be formed by a punch means or the like. In the preferred embodiment, these raised portions or dimples 36,38 form generally dome-shaped configurations with a circular base, although such raised portions can assume a variety of other configurations as well. In the preferred embodiment, the upper raised portions 36 are positioned above the horizontal center line (from bottom to top) of the box 12, while the raised portions 38 are positioned below the horizontal center line (from bottom to top) of the box 12. The inner surfaces of the sides 18 and 19 are preferably free of any raised portions, although they may, if desired, be provided with the lag bolt openings 30 and 31 and openings such as the pilot holes 39 for tooling. One or more of the sides 20 and 21 may also, if desired, be provided with pilot openings for tooling.

In the preferred embodiment, the box 12 is designed to receive a wooden or other material post with a square cross-sectional configuration and having a nominal dimension of 4"×4" and an actual dimension of 3½"×3½". Thus, the interior dimension of the open to and thus the dimension between opposite sides 19, 21 and 18,20 is a little over 3½ inches. This dimension, coupled with the raised portions 36 and 38 on the sides 20 and 21, accommodates an actual 3½ inch post which is either slightly oversized or slightly undersized. Preferably the raised portions 36,38 extend inwardly from the sides 20 and 21 a distance of about ⅛ to ¼ of an inch.

Figure 9:
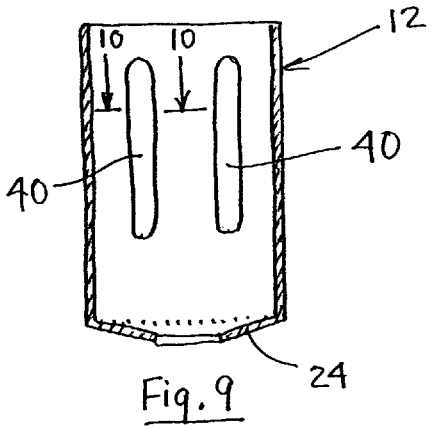
FIG. 9 is an elevational view (similar to FIG. 4) showing a further configuration of the inwardly raised portions.
Figure 11:
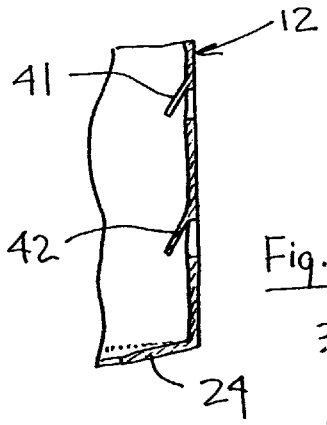
FIG. 11 is a view, partially in section, similar to FIG. 5 showing a further embodiment of a raised portion in accordance with the present invention.

Structures other than a plurality of the inwardly raised dome-shaped portions 36 and 38 may also be used. For example, as shown in FIG. 9, the inwardly extending raised portions on the sides 20 and 21 comprise a pair of inwardly extending raised strips 40,40 which are elongated from top to bottom and include at least a portion above the horizontal center line and a portion below the horizontal center line of the box 12. This assists in the stabilizing of the post 13 (FIG. 1) within the box 12 and minimizes any pivoting action of the post relative to the raised portions. In addition to the sides 20 and 21 having at least one raised member or portion of a raised member above and below the horizontal center line (from bottom to top) of the box 12, such sides 20 and 21 also preferably have a raised member (or portion of a raised member) on opposite sides of the vertical center line (extending from side to side) of the box 12. With this structure, the portion of the post 13 (FIG. 1) inserted into the box 12 is stabilized and any pivoting or other movement relative to the raised members or within the box is minimized or eliminated.

Figure 10:
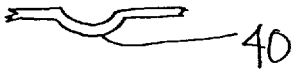
FIG. 10 is a view partially in section, as viewed along the section line 10—10 of FIG. 9.

A further embodiment of raised portions on the inner surface of the sides 20 and 21 is shown in the sectional view of FIG. 10. In this view, the raised portions are comprised of the tabs 41 and 42 which are cut from the sides 20 and 21 and bent inwardly so that the cut portions of the ends of the tabs 41 and 42 face the bottom end of the box 12.

Figure 8:
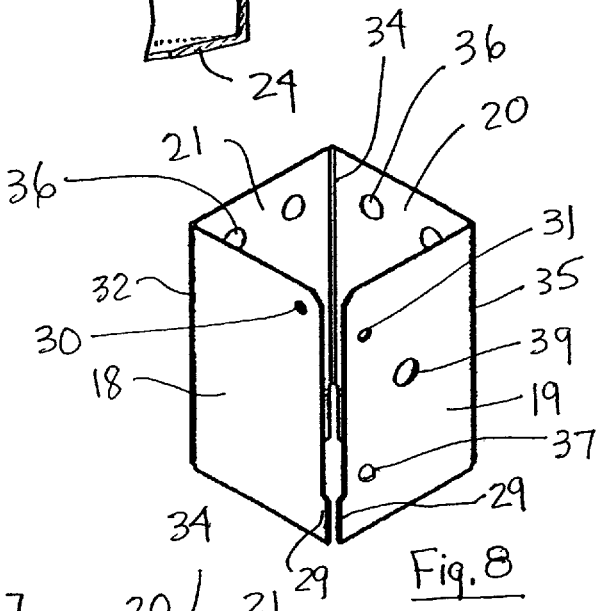
FIG. 8 is an isometric view of the post receiving box after it has been bent from the blank of FIG. 7, but prior to welding or other connection.
Figure 7:
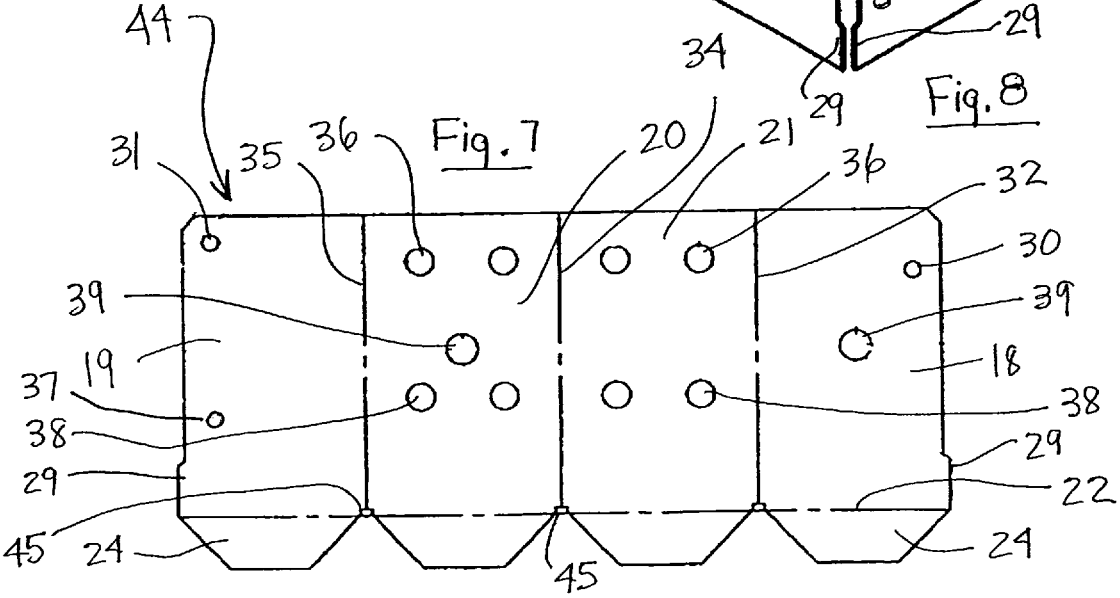
FIG. 7 is a blank of the post receiving box after it is stamped from material stock and prior to being bent and welded into the post receiving box of the post support.

Reference is next made to FIGS. 7 and 8 showing the blank from which the post support is made and the post receiving box formed from such blank. The blank 44 of FIG. 7 includes the sides 18, 21, 20 and 19 which are integrally joined with one another along their side edges defined by the bend lines (and eventual corners) 32, 34 and 35. Each of the sides 18–21 includes an integrally formed tab 24 extending downwardly from the bottom edge along the fold lines which ultimately form the bottom corners 22. Each of the adjacent side edges of the flaps 22 is spaced from one another at the point 45. This results in a gap between the tabs 24 when the box 12 is assembled to receive the upper ends of the legs 14 for welding. The lower end of each of the outer side edges of the sides 18 and 19 is provided with a short tab

29 which is welded together when the box 12 is assembled. The raised portions are formed on the inner surface of the sides 20 and 21 by a punch process or the like. In the preferred embodiment, the blank 44, and thus the box 12, is constructed from 14 gauge galvanized steel. The legs 14 (FIG. 1) of the ground engaging portion 11 are constructed of 13 gauge galvanized steel.

To form the box 12 from the blank 44, the tabs 24 are bent inwardly along the fold line defining the corner 22 so that they form the angle "A" relative to their respective sides and each of the sides 18, 19, 20 and 21 is bent inwardly along the fold lines defining the corners 32, 34 and 35 to form the box-like configuration shown in FIG. 8. The lower portions of the adjacent side edges of the sides 18 and 19 in the area of the tabs 29,29 are then welded together. The top ends of the legs 14 (FIGS. 1 and 2) are then positioned in the gaps between the side edges of the tabs 24 and are welded into that position.

During use, the post support may be driven into the ground and a post 13 inserted into the open end of the box 12. Alternatively, the post 13 may be initially inserted into the box and then driven into the ground. To retain the post 13 within the box 12, a pair of lag bolts 17 or other similar connecting members are inserted through the openings 30 and 31 and threadedly advanced into the post 13.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

The invention claimed is:

1. A post support assembly comprising:

first, second, third and fourth substantially planar sides, each having an inner surface, an outer surface, a top edge, a bottom edge and a pair of side edges, said first second, third and fourth sides forming a rigid, rectangular post receiving box with corners defined by side edges of adjacent sides;

wherein each side of said one pair of said adjacent sides comprises a portion of their respective adjacent side edges permanently connected to one another to form a connected portion near their respective bottom edges while the remaining portion of their respective adjacent side edges being unconnected between said connected portion and the top edges of said first and second sides;

a first lag bolt receiving opening through each of said sides of said one pair of adjacent sides, each of said first lag bolt receiving openings being above the centerline of its respective side; and a second lag bolt receiving opening through at least one of said sides of said one pair of adjacent sides, said second lag bolt opening being below the centerline of its respective side, wherein each of said first lag bolt receiving openings and said second lag bolt receiving openings is positioned in its respective side;

a post having an end inserted into said post receiving box; and a lag bolt extending through each of said first and second lag bolt receiving openings and into said post.

2. The post support assembly of claim 1 including at least one raised portion on the sides opposite to said one pair of adjacent sides.

* * * * *